United States Patent [19]

Peer, Jr. et al.

[11] Patent Number: 4,775,098

[45] Date of Patent: Oct. 4, 1988

[54] CARTON WITH A RECLOSABLE POUR OPENING

[75] Inventors: A. Dean Peer, Jr., Parker; Kevin R. Rusnock, Boulder, both of Colo.

[73] Assignee: Adolph Coors Company, Golden, Colo.

[21] Appl. No.: 131,762

[22] Filed: Dec. 11, 1987

[51] Int. Cl.[4] ..... B65D 43/16

[52] U.S. Cl. ..... 229/123.3; 229/125.09; 229/125.15; 229/125.17; 229/160.2

[58] Field of Search ..... 229/123.2, 125, 125.09, 229/125.14, 125.15, 125.17, 160.2, 123.1, 123.3

[56] References Cited

U.S. PATENT DOCUMENTS

| | | | |
|---|---|---|---|
| 2,317,355 | 4/1943 | Bensel | 229/17 R |
| 2,321,050 | 6/1943 | Seymer | 229/125.09 |
| 2,437,926 | 3/1948 | Ball et al. | 229/17 R |
| 2,773,634 | 12/1956 | Negoro | 229/123.2 |
| 2,826,348 | 3/1958 | Schroeder et al. | 229/125.09 |
| 2,898,822 | 8/1959 | Moore | 93/51 |
| 2,980,311 | 4/1961 | Baselt | 229/37 R |
| 3,006,525 | 10/1961 | Herrmann | 229/17 R |
| 3,029,009 | 4/1962 | Hill | 229/17 R |
| 3,039,669 | 6/1962 | Hill | 229/17 R |
| 3,101,879 | 8/1963 | Meyer-Jagenberg | 229/123.3 |
| 3,250,436 | 5/1966 | Kurtz | 229/125.15 |
| 3,357,627 | 12/1967 | Hill | 229/17 R |
| 3,768,719 | 10/1973 | Johnson | 229/7 R |
| 3,811,564 | 5/1974 | Braber | 206/469 |
| 3,883,034 | 5/1975 | Rausing | 229/125.09 |
| 3,900,155 | 8/1975 | Rausing et al. | 229/7 R |
| 4,632,299 | 12/1986 | Holmberg | 206/626 |
| 4,650,078 | 3/1987 | Desmond et al. | 206/626 |
| 4,706,875 | 11/1987 | Blackman | 229/125 |

*Primary Examiner*—Stephen Marcus
*Assistant Examiner*—Gary E. Elkins
*Attorney, Agent, or Firm*—Klaas & Law

[57] ABSTRACT

A sealed end paperboard carton having a pour opening formed in one end panel thereof and a base member formed from a relatively rigid plastic material secured to the one end panel. The base member has a hingedly mounted movable panel which has an integral closure plug fitting into and sealing the pour opening and which may be moved to an open position to permit materials in the carton to be removed through the pour opening and back to a closed position wherein the closure plug seals the pour opening. A retainer tab is provided for holding the movable panel in an open position.

20 Claims, 1 Drawing Sheet

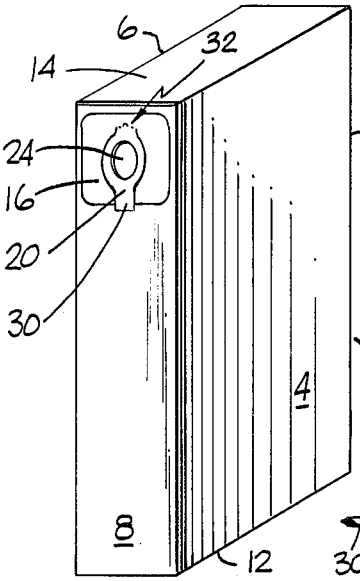
FIG. 1
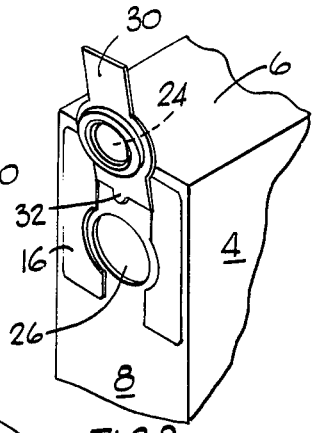
FIG 8
FIG. 7
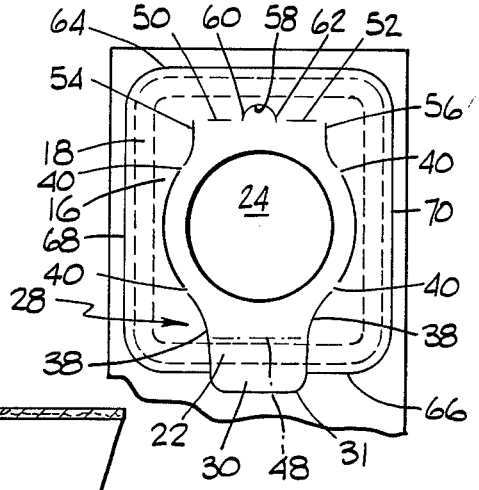
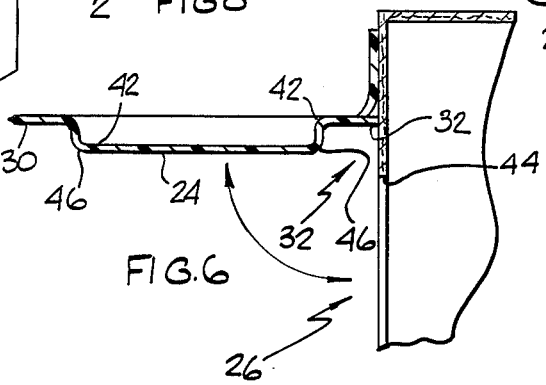
FIG. 6
FIG. 2
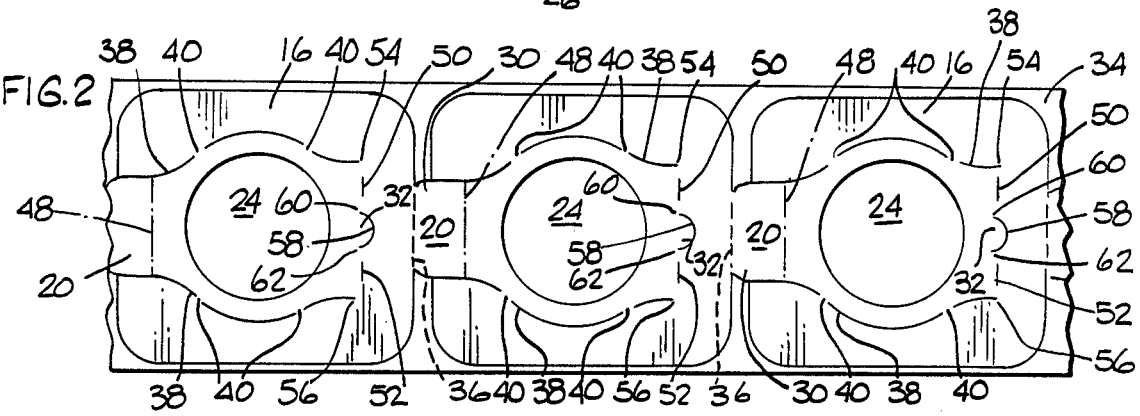
FIG. 3
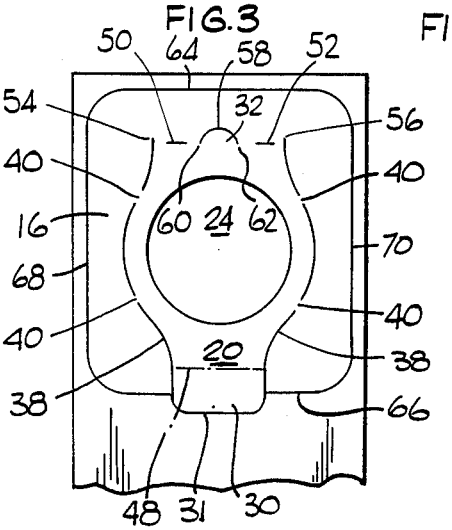
FIG. 4
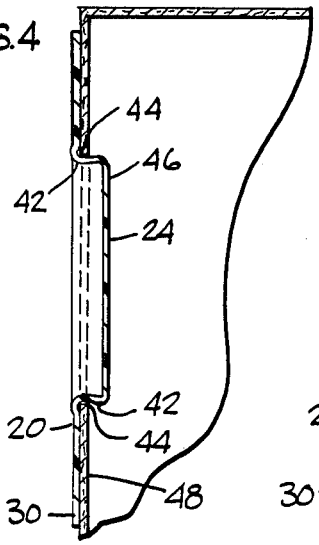
FIG. 5
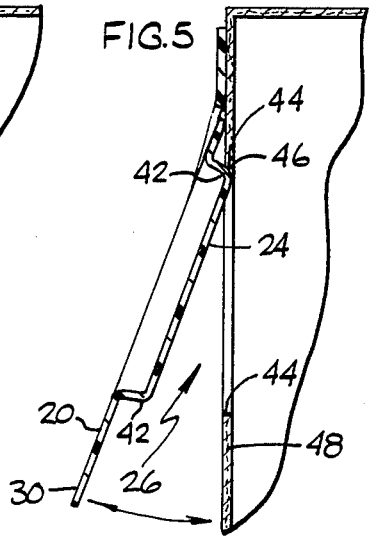

CARTON WITH A RECLOSABLE POUR OPENING

FIELD OF THE INVENTION

This invention relates generally to cartons for holding materials which are adapted to be dispensed in portions and more particularly to a sealed end carton having a pour opening and a closure plug therefor so that the pour opening may be open or closed as desired.

BACKGROUND OF THE INVENTION

Pour openings have been provided for sealed end cartons for many years and numerous types of closure means have been provided so as to open or close the pour openings. Conventionally, the closure means has been formed from a material the same as or closely similar to the material in the carton. In some instances, the closure means comprises a hinged metal pour spout that is attached to an end wall panel. These metal pour spouts add a significant cost to the manufactured product. Some plastic closure means have been provided for pour openings formed in the top panel of the carton.

BRIEF DESCRIPTION OF THE INVENTION

This invention provides a relatively rigid closure plug means for opening or closing a pour opening means in a wall panel of a sealed carton. The closure plug means comprises a portion of base member means formed from a relatively rigid plastic material that can be readily secured to the end wall panel. Also, a retainer tab is formed in the base member means and moves at the same time as the closure plug means so as to hold the closure plug means in an open position so that materials in the sealed carton may be dispensed through the pour opening means.

In a preferred embodiment of the invention, a sealed end carton is provided with a pour opening means in one of its end wall panels. The sealed end carton is preferably formed from a composite material such as that disclosed in U.S. Pat. No. 4,254,173 to A. D. Peer, Jr. Base member means, comprising a relatively rigid plastic material such as high density polyethylene, are secured to the end wall panel by suitable means such as ultrasonic welding to form a continuous seal surrounding but spaced from the pour opening means. Movable panel means are hingedly connected to the base member means by hinge means and are initially secured to the end wall panel by a portion of the continuous seal. Closure plug means are provided on the movable panel means and initially have a portion thereof extending through the pour opening means to form a seal therefor. Finger tab means are provided on the movable panel means so that the movable panel means may be moved so that the closure plug means may be removed from the pour opening means when desired. Delamination limiting means comprising a cut line extending partially through the end wall panel are located between the portion of the continuous seal holding the movable panel means to the end wall panel and the pour opening means so as to limit the extent of any delamination of the end wall panel. Retainer tab means comprising a portion of the movable panel means are provided and function to hold the closure plug mean in an open position after the movable panel means have been rotated about the hinge means through an arc greater than ninety degrees.

BRIEF DESCRIPTION OF THE DRAWING

An illustrative and presently preferred embodiment of the invention is shown in the accompanying drawing in which:

FIG. 1 is a perspective view of a sealed end carton incorporating this invention;

FIG. 2 is a top plan view of a plurality of joined together base member means;

FIG. 3 is a front elevational view of base member means secured to an end wall panel;

FIG. 4 is a cross-sectional view of the upper left hand corner of the sealed end carton;

FIG. 5 is a cross-sectional view showing the closure plug means partially opened;

FIG. 6 is a cross-sectional view showing the closure plug means being held open at an angle of about ninety degrees;

FIG. 7 is a side elevational view illustrating the continuous seal; and

FIG. 8 is a pictorial view showing the closure plug means in a fully opened position.

DETAILED DESCRIPTION OF THE INVENTION

A preferred embodiment of the invention is illustrated in the drawing and comprises a sealed end carton 2, illustrated in FIG. 1, having opposed side wall panels 4 and 6, opposed end wall panels 8 and 10, a bottom wall panel 12 and a top wall panel 14. The sealed end carton is preferably formed from a composite material such as that described in U.S. Pat. No. 4,254,173 to A. D. Peer, Jr., so that its outer surface is a plastic material such as polyethylene. Base member means 16 are secured to the end wall panel 8 by a continuous seal 18, illustrated in FIG. 7, preferably formed by ultrasonic welding. Base member means 16 are preferably formed from a relatively rigid material such as a high density polyethylene. Movable panel means 20 are hingedly connected to the base member means 16 and are initially secured to the end wall panel 8 by a portion 22 of the continuous seal 18. Closure plug means 24 are provided on the movable panel means 20 and function to open or close pour opening means 26 formed in the end wall panel 8 as described more fully below. In addition to securing the base member means 16 to the end wall panel 8, the continuous seal 18 provides support for the portion of the end wall panel 8 surrounding the pour opening means 26 so that the closure plug 24 may be used in repeated operations to open or close the pour opening means. Delamination limiting means 28 are provided in the end wall panel 8 and function to limit the delamination of the outer surface of the end wall panel 8 when the movable panel means 20 are moved to break the continuous seal 18. Finger tab means 30 having a bottom edge 31 are provided on the movable panel means 20 so that the finger tab means 30 may be grasped so as to move the movable panel means 20 to remove the closure plug means 24 out of the pour opening means 26 so that materials may be dispensed therethrough. Retainer tab means 32 comprising a portion of the movable panel means 20 function to hold the closure plug means 24 in an open position, as illustrated in FIG. 6, after the movable panel means have been moved through an arcuate distance greater than ninety degrees.

The closure plug means 24 are formed in a continuous strip 34 of plastic material, preferably a high density polyethylene, by a thermal and blow molding operation. As illustrated in FIG. 3, after the continuous strip 34 has been cooled, the base member means 16 are formed by cutting, scoring and punching operations in the continuous strip 34 of relatively rigid plastic material and then separated from the continuous strip 34. One base member means 16 is joined to the next adjacent base member means 16 by a perforated line 36 so that they may be readily separated one from the other. Also, the perforated line 36 allows the base member means 16 to be formed into a spool (not shown) for subsequent manufacturing operations.

The movable panel means 20 are formed by spaced apart perforated lines 38 in the base member means 16 and are initially held in place on the base member means 16 by spaced apart web portions 40 which may be readily broken when desired. As illustrated in FIGS. 4–6, the closure plug means 24 has a circumferential wall portion 42 extending through the pour opening means 26 and in contact with the inner edge portion 44 of the pour opening means 26. The circumferential wall portion 42 has an end portion 46 having a cross-sectional configuration slightly greater than the cross-sectional configuration of the inner edge portion 44 so as to hold the closure plug means 24 in the closed position until sufficient force is applied thereto when it is desired to open the pour opening means 26. As illustrated in FIGS. 4–6, the circumferential wall portion 42 is formed as a tapering wall to provide an interference fit with the inner edge portion 44 of the pour opening means.

The delamination limiting means 28 comprises a cut line 48 extending partally into the end wall panel 8. As illustrated in FIG. 7, the cut line 48 is located between the portion 22 of the continuous seal 18 and the pour opening means 26 and spaced only a slight distance from the portion 22. The cut line 48 extends into the end wall panel 8 for a distance not greater than fifty per cent of the thickness of the end wall panel 8.

The movable panel means 20 are connected to the base member means 16 by hinge means formed by spaced apart linear cut lines or slits 50 and 52 extending on a linear line between the ends 54 and 56 of the cut lines 38. The material in the base member means 16 between the linear slits 50 and 52 and the ends 54 and 56 holds the movable panel means 20 to the base member means 16 while the linear slits 50 and 52 cooperate therewith in providing the hinge means for permitting the movement of the movable panel means 20.

The retainer tab means 32 are formed by cut line 58 which is preferably arcuate in shape having ends 60 and 62 on the linear line between the ends 54 and 56. In operation, the retainer tab means 32 rotates with the movable panel means 20 around the hinge means formed by the slits 50 and 52 and because of its relatively rigid characteristics pushes a portion of the end wall panel 8 away as it moves. After the movable panel means 20 has been moved through an arcuate distance greater than ninety degrees and then released, the retainer tab means 32 will abut against the adjacent portion of the end wall panel 8 to hold the closure plug means 24 in an open position, as illustrated in FIG. 6, so that a portion of the materials in the sealed end carton 2 may be dispensed through the pour opening means 26.

The sealed end carton 2 is formed in a conventional operation by cutting a carton blank from a continuous sheet of composite material and forming in the carton blank the desired cut and score lines and the pour opening means 26. The carton blank is then moved to the next station where a base member 16 is positioned over the end wall panel 8 of the carton blank and the closure plug means 24 are inserted through the pour opening means 26. An ultrasonic horn tip is then moved against the base member means 16 and operated to weld together adjacent portions of the base member means 16 and the end wall panel 8 to form the continuous seal 18. The carton blank is then folded in a conventional operation to form a folded carton which is packaged with other folded cartons and shipped to a manufacturing location where the carton is formed, filled with materials and sealed.

When a purchaser desires to open the sealed end carton, the finger tab means 30 are grasped and an outwardly directed force is applied thereto. The outwardly directed force moves the movable panel means 20 to sever the portion 22 of the continuous seal 18 and the portion of the end wall panel 8 between the portion 22 and the cut line 48 is delaminated. As the movable panel means 20 are rotated around the hinge means, the web portions 40 are broken and the closure plug means 24 are pulled out of the pour opening means 26. After the movable panel means 20 have been rotated through an arcuate distance greater than ninety degrees, the finger tab means 30 may be released and the retainer tab means will function to hold the closure plug means 24 in an open position, as described above, so that materials in the sealed end carton 2 may be dispensed through the pour opening means 26.

The size of the base member means 16 may be varied to cooperate with the various sizes and shapes of the pour opening means. In the embodiment illustrated in the drawing, the carton 2 was formed from the material described in the Peer, Jr., patent and has a length between the top and bottom wall panels of about 9.0 inches, a width between the end wall panels of about 6.0 inches and a thickness between the side wall panels of about 2.0 inches and has a circular pour opening with the inner edge 44 having a diameter of about 1.0 inch. The base member means 16 has a length extending between a linearly extending top edge portion 64 and a linearly extending bottom edge portion 66 of about 1.9 inches and a width extending between opposite side edge portions 68 and 70 of about 1.75 inches. The movable panel means 20 has a linear extent between the ends 54 and 56 and the bottom edge portion 31 of about 1.75 inches and the distance between the ends 54 and 56 is about 0.875 inch. Each cut line 38 has arcuate portions with the greatest distance between the cut lines 38 being about 1.25 inches. The diameter of the end portion 46 is about 1.001 inch. The continuous seal 18 has a width of about 0.125 inch and the outer edge thereof is spaced from each of the top, bottom and side edge portions a distance of about 0.062 inch. The base member means 16 is formed from a high density polyethylene.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A sealed end carton having reclosable pour opening means comprising:

a carton having at least one side wall panel, a bottom wall panel and a top wall panel;

pour opening means formed in one of said panels defined by a continuous edge wall portion for removing material from said carton;

closure plug means having a wall portion thereof extending through said pour opening means so as to seal said pour opening means;

movable panel means for moving said closure plug means between a closed and an opened position and having said closure plug means formed therein;

base member means secured to said one of said panels by continuous seal means surrounding but spaced from said pour opening means for detachably securing said movable panel means on said carton;

hinge means for hingedly connecting said movable panel means to said base member means;

finger tab means on said movable panel means so that said movable panel means may be moved to said opened position wherein said closure plug means is removed from said pour opening means; and said base member means comprises a relatively rigid plastic material.

2. A sealed carton as in claim 1 and further comprising:

retainer tab means for holding said movable panel means in said open position.

3. A sealed end carton as in claim 1 wherein:

said at least one side wall panel comprises a pair of opposed side wall panels and a pair of opposed end wall panels;

said sealed end carton is formed from a composite material having an outer surface formed from a plastic material;

said one of said panels is one of said end wall panels; and said hinge means are located between said pour opening means and said top wall panel.

4. A sealed end carton as in claim 1 and further comprising:

said at least one side wall panel comprises a pair of opposed side wall panels and a pair of opposed end wall panels;

said one of said panels is one of said end wall panels;

said base member means having a top edge portion, a bottom edge portion and two opposite side edge portions;

said finger tab means extending downwardly from said bottom edge portion;

at least a pair of spaced apart severable perforated line means in said base member extending from said bottom edge portion to locations spaced from said top edge portion and having terminal ends located between said pour opening means and said top edge portion and spaced equidistantly from said top edge portion so that said movable panel means may be moved to said open position; and retainer tab means for holding said movable panel means in an open position.

5. A sealed end carton as in claim 4 wherein said hinge means comprises:

at least two spaced apart, linearly extending cut lines extending between said terminal ends and spaced therefrom so that portions of said base member means therebetween may function as spaced apart hinge means.

6. A sealed end carton as in claim 5 wherein said retainer tab means comprises:

a cut line having spaced apart ends located on a line parallel to said linearly extending cut lines and with a portion of said cut line between said ends extending toward said top edge portion.

7. A sealed end carton as in claim 6 wherein:

said portion of said cut line between said ends is arcuate.

8. A sealed end carton as in claim 1 and further comprising:

a delamination limiting cut line extending partially through said one of said panels and located between the portion of said continuous seal means on said movable panel means and said pour opening means for limiting delamination of the material forming an outer surface of said one of said panels.

9. A sealed end carton as in claim 1 and further comprising:

an end portion on said circumferential wall portion of said closure plug means; and said end portion having a cross-sectional configuration slightly greater than the cross-sectional configuration of said pour opening means so as to retain said closure plug means in a closed position in said pour opening means until a sufficient external force is applied to pull said end portion of said closure plug means through said pour opening means.

10. A sealed end carton as in claim 9 wherein:

said continuous edge of said pour opening means is circular.

11. A sealed end carton as in claim 10 and further comprising:

said wall portion of said closure plug means having an outer surface having a interference fit with said continuous edge to ensure a good seal for said pour opening means.

12. A sealed end carton as in claim 1 wherein:

said base member means having a top edge portion, a bottom edge portion and two opposite side edge portions;

said top edge portion extending in a linear direction;

said hinge means are located between said pour spout means and said top edge portion and extend in a linear direction parallel to said top edge portion; and retainer tab means for holding said movable panel means in said opened position.

13. A sealed end carton as in claim 12 wherein said retainer tab means comprises:

a cut line having ends lying on a line extending through said hinge means and with the portion of said cut line between said ends extending toward said top edge portion.

14. A sealed end carton as in claim 13 wherein:

said portion of said cut line between said ends is an arc of a circle.

15. A sealed end carton as in claim 14 wherein:

said circle has a center located between said line extending through said hinge means and said pour opening means.

16. A sealed end carton as in claim 3 wherein:

said base member means is formed from a plastic material which is substantially more rigid than said paperboard material in said one end wall panel.

17. A sealed end carton as in claim 14 wherein:

said finger tab portion extends downwardly from said bottom edge portion; and said movable panel means comprises at least a pair of spaced apart perforated lines in said base member means extending from said bottom edge portion to locations spaced from said top edge portion and having terminal ends located between said pour opening means and said top edge portion and spaced equidistantly from said top edge portion so that said movable panel means may be moved to said open position.

18. A sealed end carton as in claim 17 wherein said hinge means comprises:

at least two spaced apart, linearly extending cut lines extending between said terminal ends and spaced therefrom so that portions of said base member means therebetween may function as spaced apart hinge means.

19. A sealed end carton as in claim 18 and further comprising:

an end portion on said circumferential wall portion of said closure plug means;

said end portion having a cross-sectional configuration slightly greater than the cross-sectional configuration of said pour opening means so as to retain said closure plug means in a closed position in said pour opening means until a sufficient external force is applied to pull said end portion of said closure plug means through said pour opening means; and said wall portion of said closure plug means having an outer surface having an interference fit with said continuous edge to ensure a good seal for said pour opening means.

20. A sealed end carton as in claim 19 and further comprising:

said sealed end carton is formed from a composite material having an outer surface formed from a plastic material; and a delamination limiting cut line extending partially through said one of said panels and located between the portion of said continuous seal means on said movable panel means and said pour opening means for limiting delamination of the material forming an outer surface of said one of said panels.

* * * * *